US005422044A

United States Patent [19]

Cheng

[11] Patent Number: 5,422,044

[45] Date of Patent: Jun. 6, 1995

[54] METHOD AND APPARATUS FOR MIXING A COLD GAS WITH A HOT LIQUID

[75] Inventor: Alan T. Y. Cheng, Livingston, N.J.

[73] Assignee: Praxair Technology, Inc., Danbury, Conn.

[21] Appl. No.: 232,983

[22] Filed: Apr. 25, 1994

[51] Int. Cl.[6] ..... B01F 3/04

[52] U.S. Cl. ..... 261/128; 261/129; 261/161

[58] Field of Search ..... 261/128, 129, 161

[56] References Cited

U.S. PATENT DOCUMENTS

| | | | |
|---|---|---|---|
| Re. 32,562 | 12/1987 | Litz | 261/91 |
| 1,806,394 | 5/1931 | Giesler et al. | 261/161 |
| 3,735,568 | 5/1973 | Beck | 261/161 |
| 4,444,698 | 4/1984 | Lang et al. | 261/161 |
| 4,919,849 | 4/1990 | Litz et al. | 261/36.1 |
| 5,004,571 | 4/1991 | Litz et al. | 261/91 |
| 5,009,816 | 4/1991 | Weise et al. | 261/21 |
| 5,241,092 | 8/1993 | Cheng et al. | 554/205 |

*Primary Examiner*—Tim Miles
*Attorney, Agent, or Firm*—Alvin H. Fritschler

[57] ABSTRACT

A gas injection and heating device and method for the bubbling of a gas into a body of hot liquid to be interacted with the gas. The device comprises an elongate heat exchange gas container, designed to be immersed in the hot liquid to pre-heat the gas in situ by heat exchange with the liquid. Cold gas is supplied to the elongate gas container, circulated therethrough to become heated to the liquid temperature, and then released from a nozzle into the depth of the liquid in the form of small bubbles of hot gas having a large liquid interfacial mass transfer area.

16 Claims, 2 Drawing Sheets

METHOD AND APPARATUS FOR MIXING A COLD GAS WITH A HOT LIQUID

BACKGROUND OF THE INVENTION

1. Field of the Invention

The present invention relates to improvements in systems which involve the sparging or bubbling of a gas into a hot liquid for any one of a variety of purposes, such as deodorizing aeration, liquid oxidation reaction (LOR), hydrogenation, or other action, in which the effectiveness or efficiency of the system is dependent upon mass transfer through a gas-liquid interface which, in turn, is dependent upon the surface-to-volume ratio of the gas bubbles. Smaller gas bubbles have a larger surface-to-volume ratio and are less buoyant than larger bubbles and therefore provide a greater gas-liquid interface and dwell time for producing the desired results such as dissolution, oxidation-displacement, chemical reaction or other gas-liquid interchange.

2. Description of the Prior Art

Gas sparging or bubbling through hot liquids, such as edible oils and other melted oleaginous materials, is commercially employed for a variety of purposes, and reference is made to commonly—owned U.S. Pat. Nos. 4,919,894; 5,004,571; 5,009,816 and Re: 32,562. These representative patents disclose various Advanced Gas Reactor (AGR) gasification and recirculation systems which employ a draft tube as an impeller-surround to draw a gas down from an overhead gas space into an impeller to mix it with the bulk liquid for the intended purpose.

The gas bubbles formed in such AGR systems, by single or multiple impeller agitation of the liquid and/or by subsurface introduction of fresh gas as shown in U.S. Pat. No. 5,004,571, do not have a large surface-to-volume ratio. A single passage of the gas through the liquid does not provide a satisfactory gas-liquid interchange, and therefore the AGR systems depend upon continuous recirculation of the gas from the overhead gas space, and agitation through the impeller, to produce the desired gas-liquid interchange. Suction of the overhead gas down into the impeller is dependent upon the level of the liquid within the vessel, so that system can be troublesome well as inefficient.

It is also known other commercial aeration-type systems to utilize pipe spargers, sintered metal spargers or injectors with various nozzles.

Mass transfer through the gas-liquid interface is quite often the controlling factor in gas-liquid reaction and stripping operations. Smaller bubbles have a larger surface-to-volume ratio than large bubbles, and therefore, reaction or mass transfer will proceed faster with smaller bubbles than with larger bubbles. Therefore, various types of spargers are used to introduce fine bubbles into a liquid. However, the temperature of a hot liquid can be substantially higher than the temperature of the injection gas. For example, the temperature of an edible oil under deodorization conditions can be as high as 650° F. The gas being injected at room temperature will form bubbles as a function of the orifice size and pressure. As a small bubble rises through the hot oil, it is heated up rapidly to the operation temperature, and the volume of the gas expands with the rise in temperature. The expanded bubble has a very small surface to volume ratio, resulting in an undesirable reduction in mass transfer rate.

The problem associated with expanding bubble size is significant, particularly if gas consumption is critical. For example, the nitrogen consumption has to be kept to a minimum in order for a nitrogen deodorizer to operate economically. Motive is required in vacuum jets to create high volume for operating a nitrogen deodorizer. If the flow rate of the non-condensable nitrogen increases, the motive steam requirement will increase substantially. In that case, the nitrogen deodorizer may no longer be competitive with the steam deodorizer.

In hydogenation or oxygenation reactions, gas bubbles rise from the bottom of the tank to the liquid surface and are lost unless a recycle mechanism such as used in the LOR or AGR systems reuses the headspace oxygen or hydrogen. However, the reaction rate can be improved if the gas is dissolved in the first pass. Smaller bubbles, without thermal expansion, will dissolve at a faster rate due to high interfacial area. With increased oxygen or hydrogen dissolution the selectively and amount of byproduct formation may also change. For a large process, a 10% improvement in selectively and rate can be translated into increased efficiency and economy.

Deodorizers, such as for edible oils as disclosed in U.S. Pat. No. 5,241,092, generally operate under vacuum and at high temperatures. Mechanical agitation is not feasible under such conditions since the integrity of the seals would be threatened.

SUMMARY OF THE INVENTION

The present invention provides a novel process and apparatus for preventing the heat-expansion, and corresponding reduction of the interfacial mass transfer area of bubbles of a gas introduced to a hot liquid for purposes of altering said liquid, such as by aeration, dissolution, reaction, displacement or other treatment. This is accomplished by continuously pre-heating and expanding the gas supply by efficient and rapid heat transfer from the hot liquid, while the gas supply is segregated and circulated in heat transfer association with the hot liquid, and continuously releasing the pre-heated, pre-expanded gas into the hot liquid in the form of small bubbles of the hot gas having a temperature similar to the temperature of the hot liquid, whereby further heating and expansion of the released small bubbles is avoided and the efficiency of the system is substantially increased.

The present invention provides a novel heat exchange apparatus for containing a continuous supply of gas segregated within a body of a hot liquid, and for employing the heat of the hot liquid to pre-heat a cold or room temperature gas efficiently and rapidly up to the temperature of the hot liquid, and for discharging the hot gas directly into the hot liquid in the form of small bubbles which are resistant to heat expansion at the temperature of the hot liquid, without the need for mechanical agitators.

THE DRAWINGS

FIG. 1 is a schematic cross-sectional view of an apparatus according to an embodiment of the present invention, and FIG. 2 is an enlarged vertical cross-section taken along the line 2—2 of FIG. 1.

DETAILED DESCRIPTION

Figure 1:
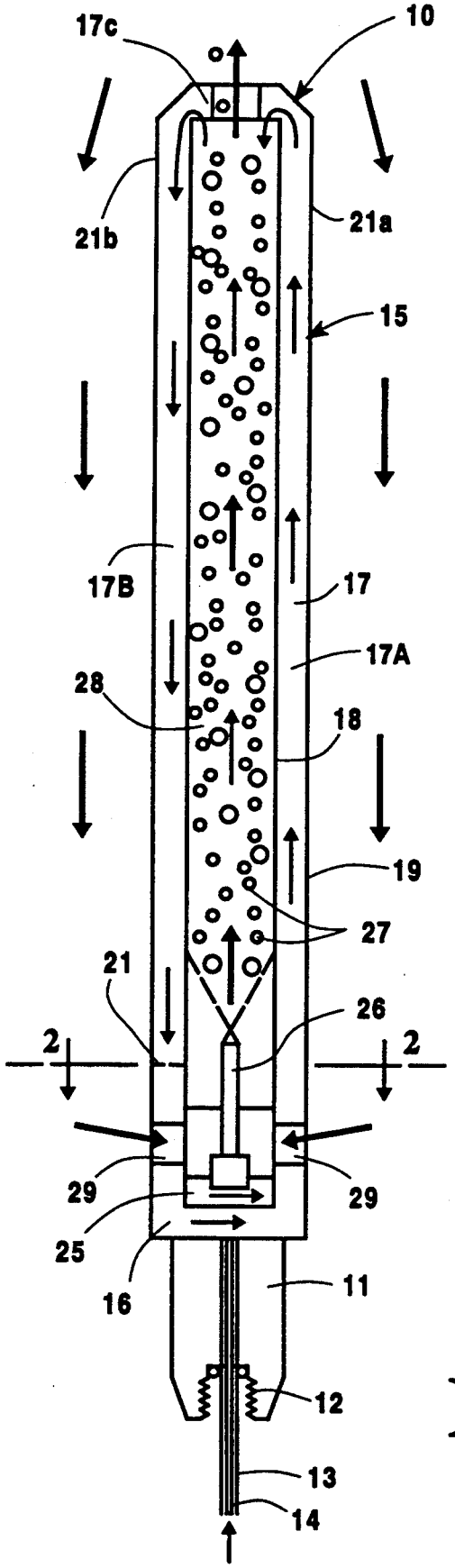
Figure 2:
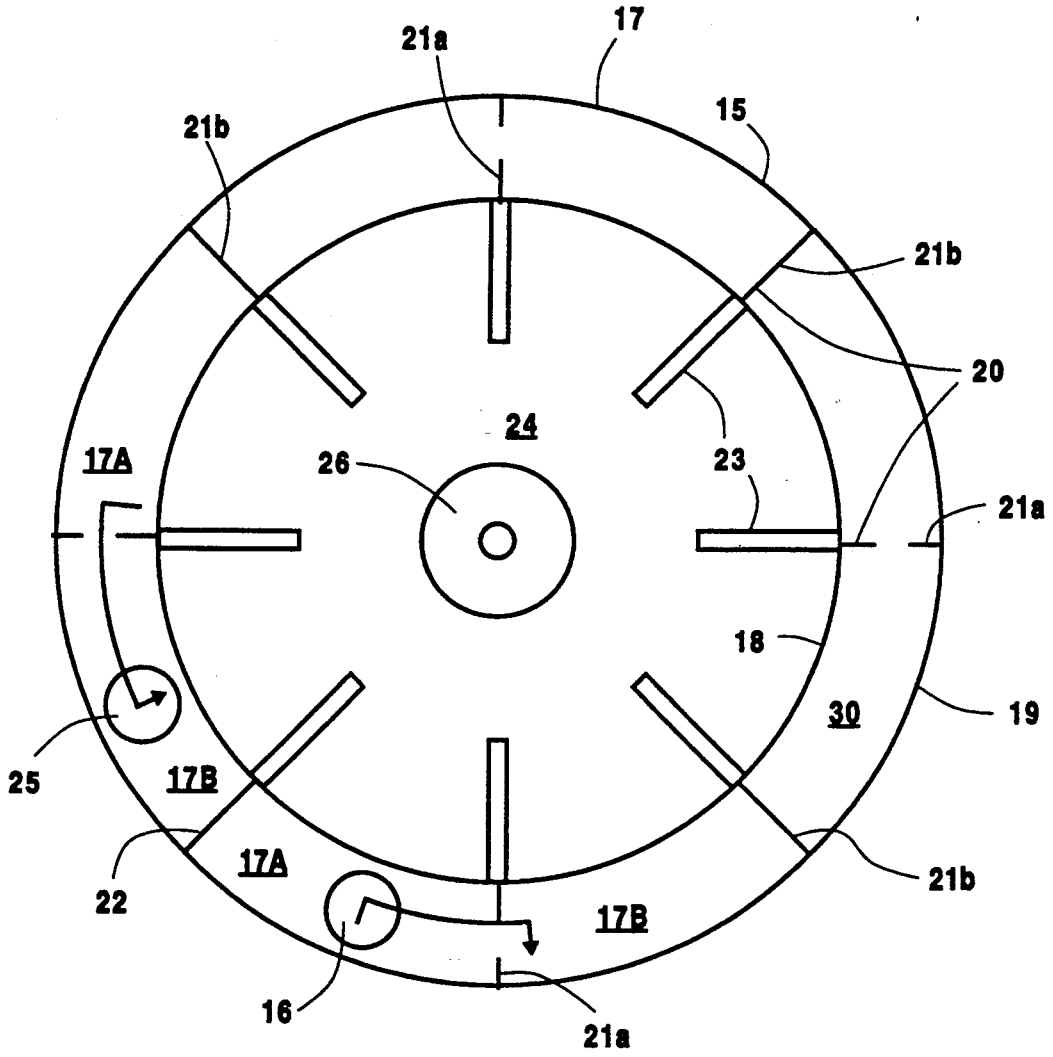

FIG. 1 illustrates a gas injection and heating element 10 of a hot liquid apparatus according to the present invention, comprising a gas injection fixture 11 having a threaded end 12 for connection to a gas supply conduit, a gas feed tube 13 and a coaxial temperature sensor tube 14. The element 10 comprises an elongate tubular gas circulation jacket 15 having a lower section 16 which is open to the gas feed tube 13 and alternate vertical sections 17A and 17B of the elongate annular circulation compartment 17 formed between the inner 18 and outer 19 walls of the jacket 15. Compartment 17 is sectioned by radial heat-transfer partitions 20 comprising alternate height dividers 21*a* and 21*b* and a full partition 22, each of which is in heat-conductive association with radial heat-transfer fins 23 which extend inwardly form the inner wall 18 of the jacket 15 into the central liquid circulation and gas/liquid mixing chamber 24, as illustrated by FIG. 2. The dividers 21 and the fins 23 place the partitions 20 into contact with the two-phase liquid flow, for improved heat transfer efficiency. The top of each height divider 21*a* is spaced downwardly from the top ring section 17C and the bottom of each height divider 21*a* sealingly engages the floor 30 of the compartment 17. The alternate height dividers 21*b* sealingly engage the top ring section 17C and are spaced from the floor 30 of the compartment 17. Thus, the gas flow within the compartment 17 is caused to follow a serpentine path upwardly through each vertical arc section 17A, over each divider 21*a*, down each vertical arc section 17B, and under each divider 21*b*.

As shown by means of arrows within the annular gas compartment 17, gas introduced to lower section 16 flows upwardly through the first vertical section 17A to top partitioned annular ring section 17C which is open to both vertical sections 17A and 17B above divider 21*a*. Then the gas is drawn down through the first vertical gas section 17B, passes under the alternate height divider 21*b*, up the next vertical section 17A and down the next vertical section 17B, to provide a serpentine circulation of the gas through eight arcuate vertical sections before exiting through passage 25 into the nozzle 26. The final partition 22 is a full partition in the annular gas chamber 17, which causes the gas entering through passage 16 to flow in the counter-clockwise direction, in serpentine fashion sequentially up each section 17A and down each section 17B in order to exit through passage 25 to the nozzle 26 in preheated condition so that the gas bubbles from the nozzle 26 are small and resistant to expansion.

Preferably the annular gas chamber 17 contains metal packing such as spheres, pellets, etc., to increase the thermal conductivity from the hot oil to the gas circulating within the chamber 17.

The withdrawal of the gas through the nozzle 26, and the vertical partitioning of the gas chamber 17, cause the gas to flow from conduit 13 through chamber 16, upwardly through the first section 17A, and downwardly through the next section 17B, in sequence, before forced through passage 25 to nozzle 26 and bubbled into the hot liquid 28 in central chamber 24.

The release of the small gas bubbles 27 from the nozzle 26 causes the bubbles to move upwardly through the central liquid chamber 24 with a velocity leading to an increase in the external heat transfer coefficient. Secondly, the gas bubbles 27 simulate nucleation boiling, which is known to have a high heat transfer coefficient. Such coefficient, rather than thermal conductivity is a controlling factor in the effectiveness of the present apparatus.

The entire gas injection and heating element 10 is submerged within the hot liquid in a vessel such as the vessel of a deodorizer. This enables the high temperature of the hot liquid being stripped to be heat-exchanged with the cold gas being introduced through conduit 13 to raise the gas temperature so that when the gas circulates to the nozzle 26 it has the same temperature as that of the liquid, as sensed by sensor tube 14 which communicates with nozzle 26. The operation of the nozzle 26 is thermostatically controlled by the sensor tube 14 to regulate the gas flow rate through the nozzle 26 and thereby regulate the dwell time of the gas within the jacket 15 to obtain the predetermined required gas temperature.

The hot liquid in which the gas injection and heating element 10 is immersed circulates through a plurality of inlet passage 29 in the lower wall area of the jacket 15, as illustrated by arrows in FIG. 1. The upward movement of the small hot gas bubbles 27 within the tubular central chamber 24 creates an upward flow of the liquid 28 within the chamber 24, which draws additional hot liquid in through the wall openings 29 for gas/liquid mixing and upward circulation to the outlet of the jacket 15 beyond the annular jacket section 17C and into the main body of the liquid within the reaction vessel.

Since the entire element 10 is immersed in the hot liquid the elongate surfaces of inner and outer walls 18 and 19 of the gas heating jacket 15 are in heat-transfer contact with the hot liquid, such as hot oil at a temperature of up to about 650° F., which heats the walls 18 and 19, the heat transfer fins 23 within chamber 24 and the associated partitions 20, 21 and 22 within the jacket 15. This rapidly raises the temperature of the cold or room temperature gas introduced to the lower jacket inlet section 16 to the same temperature as the hot oil 28 as the gas is forced to circulate up and down the vertical wall sections 17A and 17B of the jacket 15 before exiting to passage 25 to the nozzle 26.

The introduction of cold gas through the gas conduit 13 has substantially no cooling effect on the temperature of the hot liquid since the heat capacity per °F. of a liquid such as an oil is several thousand times the heat capacity of an equal volume of a gas such as nitrogen.

The novel gas injection and heating element 10 of the present invention is economical and efficient in that it uses the heat of the liquid to heat the gas rapidly, thereby avoiding the need and cost of external heating means to pre-heat an external gas supply before it is introduced to the vessel containing the hot oil. Also, external heating and supply systems require insulation means to reduce heat loss whereas in the present internal oil-heating system the gas is heated in situ to the temperature of the oil and therefore heat loss from the gas is not possible. This has the added advantage of avoiding any overheating of the gas, which can be dangerous and which could cause local overheating of the liquid. Certain liquid edible oils spoil and/or decompose rapidly at temperatures above about 530° F.

It will be apparent to those skilled in the art that the gas injection and heating element 10 of the drawings may be replaced by other immersible heat-exchange devices which circulate the enclosed gas from an inlet, through an elongate coil, honeycomb, maze or other circuitous heat exchange enclosure immersed in the hot liquid, to heat the gas up to the temperature of the liquid before the gas is sparged into the liquid from an outlet chamber, spaced from the inlet, in the form of small expansion-resistant bubbles of the hot gas. For example a tightly-wound vertical coil of copper tubing may be used to circulate the gas upwardly and then down to a lower nozzle means which releases small bubbles of the heated gas up through the center of the coil to create a liquid circulation path similar to that created by the tubular jacket 15 of the device of FIG. 1.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. Method for increasing the effectiveness of a gas bubbled into a hoe liquid for interaction therewith, by increasing the interfacial means transfer area between said liquid and said gas, comprising introducing said gas to a heat exchange enclosure immersed within a body of liquid heated to an elevated temperature in order to heat the gas to said elevated temperature by the exchange of heat from said liquid to said gas, and releasing small bubbles of said heated gas into said hot liquid for interaction therewith, said small bubbles being resistant to heat expansion of their volumes and resultant reduction in their liquid interfacial mass transfer areas at the temperature of said hot liquid.

2. Method according to claim 1 which comprises sensing the temperature of the gas within said heat exchange enclosure, in the area of the release thereof, and controlling the gas flow rate so that the temperature of the gas released is the same as the temperature of the liquid.

3. Method according to claim 1 which comprises creating a continuous recirculation path for said hot liquid through said heat exchange enclosure, and releasing said small bubbles of gas into said recirculation path.

4. Method according to claim 1 in which said heat exchange enclosure is a vertical tubular enclosure having a core which is open to the circulation of the liquid therethrough, comprising releasing said small bubbles at the bottom of said tubular enclosure into hot liquid within the core of said tubular enclosure to create an upward circulation of said liquid through said core and a continuous liquid recirculation through said core.

5. Method according to claim 1 which comprises circulating said gas through a serpentine passage within said heat exchange enclosure in order to increase its dwell time therewithin.

6. Method according to claim 1 which comprises providing said heat exchange enclosure with metallic means which absorb heat from the hot liquid and transfer said heat to said gas circulating within the enclosure.

7. Method according to claim 6 which comprises providing said enclosure with metallic partitions and with fins which extend therefrom into said hot liquid.

8. Method according to claim 6 which comprises introducing particulate metallic packing into said enclosure, and circulating said gas through said packing for improved thermal conductivity.

9. A method according to claim 8, in which the metallic packing comprises spheres or pellets.

10. A gas injection and heating device designed to be immersed within a body of hot liquid for purposes of containing and heating a gas to the temperature of the hot liquid before releasing the gas into the liquid, comprising an elongate heat exchange gas container having a large surface area for the transfer of heat from a hot liquid, in which the device is immersed, to a gas introduced within said container, said container having an inlet for the introduction, circulation and heating of a gas through said elongate container and having a nozzle, spaced from said inlet, for releasing the heated gas into said hot liquid in the form of small, expansion-resistant bubbles.

11. A device according to claim 10 further comprising temperature-sensing means associated with said nozzle for operating said nozzle only when the temperature of the gas at said nozzle reaches a predetermined value.

12. A device according to claim 10 in which said elongate container comprises a vertical tubular gas enclosure surrounding a tubular core adapted for the circulation of hot liquid therethrough when the device is immersed in hot liquid, and said nozzle being located at the bottom of said vertical tubular enclosure for the release of said heated gas up through said tubular core to create a continuous recirculation of said hot liquid up through said tubular core.

13. A device according to claim 12 in which said vertical tubular enclosure comprises inner and outer walls forming a vertically-compartmented annular gas container, gas inlet means at the base of said container for supplying gas to said enclosure, and means for causing the gas to circulate from said inlet means one or more times to the top of said tubular enclosure, and down to said nozzle means which draw the gas down from the top of said tubular enclosure and release it as small hot gas bubbles up through said tubular core.

14. A device according to claim 13 in which said annular gas container comprises vertical radial metallic partitions in heat-transfer association with vertical radial metallic heat-transfer fins which extend into said tubular core to conduct heat from the liquid in said core to the gas in said container.

15. A device according to claim 13 in which said annular gas container includes particulate metallic packing, through which the gas circulates for improved thermal conductivity.

16. A device according to claim 15, in which the metallic packing comprises spheres or pellets.

* * * * *

UNITED STATES PATENT AND TRADEMARK OFFICE

CERTIFICATE OF CORRECTION

PATENT NO. : 5,422,044

DATED : June 6, 1995

INVENTOR(S) : Alan T. Y. Cheng

It is certified that error appears in the above-identified patent and that said Letters Patent is hereby corrected as shown below:

Column 5,

Claim 1, line 2 thereof, between "bubbled into a" and "liquid", change "hoe" to -- hot --.

Signed and Sealed this

Eighth Day of August, 1995

Bruce Lehman

*Attest:*

BRUCE LEHMAN

*Attesting Officer*

*Commissioner of Patents and Trademarks*